US005804748A

United States Patent [19]

Clayton, Sr.

[11] Patent Number: 5,804,748

[45] Date of Patent: Sep. 8, 1998

[54] SOUND POST INSTALLER

[76] Inventor: William L. Clayton, Sr., 2505 W. Dewey Rd., Owosso, Mich. 48867

[21] Appl. No.: 819,481

[22] Filed: Mar. 17, 1997

[51] Int. Cl.[6] ..... G10G 7/00

[52] U.S. Cl. ..... 84/458

[58] Field of Search ..... 84/458; 294/19.1, 294/31.2

[56] References Cited

U.S. PATENT DOCUMENTS 1,466,681 9/1923 Todd ..... 84/277

1,556,340 10/1925 Myers ..... 84/277

2,522,190 9/1950 Mouser ..... 81/65

*Primary Examiner*—Michael L. Gellner

*Assistant Examiner*—Shih-yung Hsieh

*Attorney, Agent, or Firm*—Donald C. Bolger, P.C.

[57] ABSTRACT

The present invention is an improvement in the way a sound post is installed into a violin or viola. The present device secures the sound post to the device by using a cradle and wire loop. The sound post is attached to the device and then inserted through the F hole in the violin or viola and installed in the exact location. After, the sound post is set in the exact location the device releases the sound post and is removed from the violin or viola.

9 Claims, 1 Drawing Sheet

SOUND POST INSTALLER

BACKGROUND OF THE INVENTION

The field of the invention is generally that of violin and viola instruments and more specifically, to an improved device for installing a sound post in a Violin or Viola.

The violin has a foretells fingerboard. Its strings are hitched to tuning pegs and to a tailpiece passing over a bridge held in place by the pressure of the strings. The bridge transmits the strings' vibrations to the violin belly, or soundboard, which amplifies the sound. Inside the instrument, beneath the treble foot of the bridge and wedged between the violin belly and back, is the sound post, a thin stick of pine that transmits the string vibrations to the instrument's back, contributing to the characteristic violin tone. The belly is supported from beneath by the bass bar, a narrow wood bar running lengthwise and tapering into the belly. It also contributes to the resonance of the instrument.

Presently, to replace a sound post, the sound post is set in place with a sharp pointed tool or a pliers type tool, placing the sound post into the instrument through the F hole. This is an extremely difficult operation, because the sound post can fall off the sharp pointed tool, or slip off the pliers type tool. These tools do damage to the sound post in the process of installing.

The present invention solves this problem by using a cradle and wire loop device to secure the sound post making it possible to locate the exact position and then releases the sound post from the installing device.

SUMMARY OF THE INVENTION

The present invention is an improvement in the way a sound post is installed into a violin or viola. The present device secures the sound post to the device by using a cradle and wire loop. The sound post is attached to the device and then inserted through the F hole in the violin or viola and installed in the exact location. After, the sound post is set in the exact location the device releases the sound post and is removed from the violin or viola.

It is an object of the present invention to provide a novel method to install a sound post in a violin or viola.

It is a further object of the invention to provide an novel device to easily attach and release a sound post in an exact location.

It is another object of the invention to provide a low cost device for installing sound posts.

It is a further object of the invention to provide a flexible design that can easily be used by inexperienced user.

It is another object of the invention to provide a simple means to install a sound post.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the herein below described figure of the accompanying drawings and is described in detail hereinafter. There can be multiple embodiments of the invention which lie within the scope of the invention.

DESCRIPTION OF THE PREFERRED EMBODIMENTS

Figure 1:
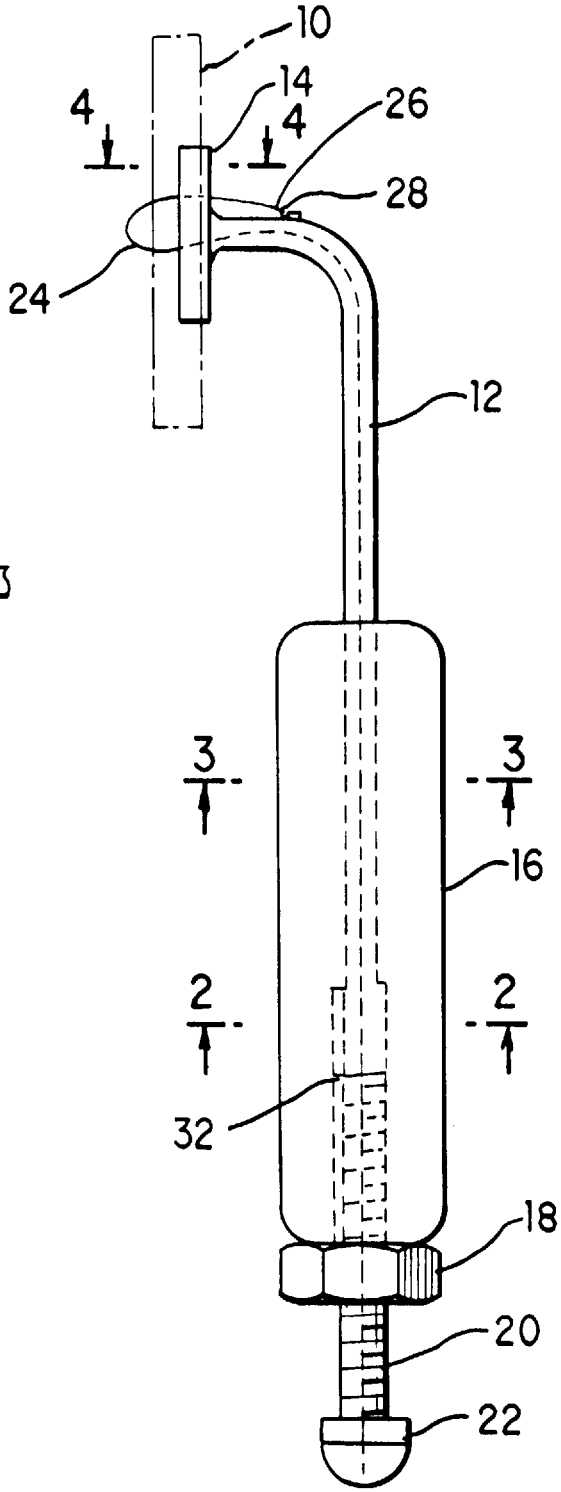
FIG. 1 is an elevation view showing one exemplary embodiment of one representative form of the invention.
Figure 4:
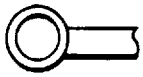
FIG. 4 is a cross section view through the cradle.
Figure 3:
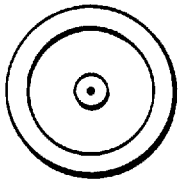
FIG. 3 is a cross section view through the handle.
Figure 2:
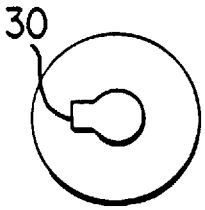
FIG. 2 is a cross section view through the handle showing the configuration of the keyway.

Referring to FIG. 1, the device is used to install sound post 10. Frame 12 has a passageway for wire 24. Cradle 14 is secured to the first end of frame 12. The first end of frame 12 has hook 28 for securing the first end of wire 24. The first end of wire 24 has a wire loop 26 which can be secured to hook 28. A hook or other attachment means could also be used.

The second end of frame 12 is secured to the first end of handle 16. Handle 16 also has a passageway for wire 24. The second end of handle 16 has keyway hole 30. Tab 32 is secured to the first end of threaded rod 20. Tab 32 keeps threaded rod 20 from turning in keyway 30. Threaded rod 20 has a passageway for wire 24. Forward nut 18 is used to adjust the position of threaded rod 20. Rearward nut 22 is used to secure the second end of wire 24.

To insert sound post 10, the first end of wire 24 is wrapped around sound post 10 and secured to hook 28. Forward nut 18 is tightened until wire 24 is tight around sound post 10. Sound post 10 is then installed in a violin or other instrument. To remove the installing device, forward nut 18 is loosened, rearward nut 22 is pushed forward and wire 24 slides through. Frame 12 snaps off of hook 28 and the device is removed from the instrument.

What is claimed is:

1. A device for installing a sound post in a musical instrument comprising:

a wire;

a frame having a first end and a second end and having support for said wire;

means for making and releasing a loop with said wire and said first end of said frame, a cradle attached to the first end of said frame;

said second end of said frame having a hole;

a threaded rod inserted in said frame hole;

said threaded rod having a first end and a second end;

said threaded rod first end secured to said wire;

a forward nut located around said threaded rod whereby turning said nut tightens and loosens said wire around said cradle;

said second end of said frame has a keyway hole;

and said threaded rod has a tab that moves in said keyway.

2. The device as recited in claim 1, wherein:

said second end of said frame has a keyway hole;

said threaded rod has a tab that moves in said keyway;

said first end of said frame has a hook;

said wire has a first end and a second end;

said wire first end secured to said hook said wire second end secured to said threaded rod.

3. A device for installing a sound post in a musical instrument comprising:

a frame having a first end and a second end;

said frame having a passageway;

a hook on said first end of said frame;

a wire having a first end and a second end;

means for securing said wire first end to said hook;

means for pulling said wire second end through said frame passageway.

4. The device as recited in claim 3, further comprising:

a cradle;

said cradle secured to said frame first end.

5. The device as recited in claim 3, further comprising:

a cradle;

said cradle secured to said frame first end;

a handle having a first end and a second end;

said handle first end secured to said frame second end.

6. The device as recited in claim 3, further comprising:

a cradle;

said cradle secured to said frame first end;

a handle having a first end and a second end;

said handle first end secured to said frame second end;

said handle having a passageway;

means for pulling said wire second end through said handle passageway.

7. The device as recited in claim 3, further comprising:

a cradle;

said cradle secured to said frame first end;

a handle having a first end and a second end;

said handle first end secured to said frame second end;

said handle having a passageway;

means for pulling said wire second end through said handle passageway;

said handle second end having a hole;

a threaded rod having a first end and a second end;

said wire second end secured to said threaded rod first end;

a forward nut;

said forward nut attached to said threaded rod whereby said forward nut adjusts the position of said wire second end.

8. The device as recited in claim 3, further comprising:

a cradle;

said cradle secured to said frame first end;

a handle having a first end and a second end;

said handle first end secured to said frame second end;

said handle having a passageway;

means for pulling said wire second end through said handle passageway;

said handle second end having a hole;

a threaded rod having a first end and a second end;

said threaded rod having a passageway;

means for pulling said wire second end through said threaded rod;

a forward nut;

a rearward nut;

said wire second end secured to said threaded rod second end by said rearward nut;

said forward nut attached to said threaded rod whereby said forward nut adjusts the position of said wire second end.

9. The device as recited in claim 3, further comprising:

a cradle;

said cradle secured to said frame first end;

a handle having a first end and a second end;

said handle first end secured to said frame second end;

said handle having a passageway;

means for pulling said wire second end through said handle passageway;

said handle second end having a keyway hole;

a threaded rod having a first end and a second end;

a tab;

said tab secured to said threaded rod first end;

said tab inserted into said handle second end keyway hole;

said threaded rod having a passageway;

means for pulling said wire second end through said threaded rod;

a forward nut;

a rearward nut;

said wire second end secured to said threaded rod second end by said rearward nut;

said forward nut attached to said threaded rod whereby said forward nut adjusts the position of said wire second end.

* * * * *